US007841284B2

(12) United States Patent
McCown

(10) Patent No.: US 7,841,284 B2
(45) Date of Patent: Nov. 30, 2010

(54) MARINE VESSEL AND SYSTEM FOR OPERATING A MARINE VESSEL

(75) Inventor: John D. McCown, Pound Ridge, NY (US)

(73) Assignee: Trailer Bridge, Inc., Jacksonville, FL (US)

( * ) Notice: Subject to any disclaimer, the term of this patent is extended or adjusted under 35 U.S.C. 154(b) by 209 days.

(21) Appl. No.: 12/033,916

(22) Filed: Feb. 20, 2008

(65) Prior Publication Data

US 2009/0209149 A1 Aug. 20, 2009

(51) Int. Cl.
*B63B 3/00* (2006.01)

(52) U.S. Cl. ..... 114/65 R

(58) Field of Classification Search ..... 114/65 R
See application file for complete search history.

(56) References Cited

U.S. PATENT DOCUMENTS 1,419,376 A * 6/1922 Hammond, Jr. ..... 318/16
4,098,077 A * 7/1978 Edmaier et al. ..... 60/272
4,356,785 A 11/1982 Bailie
4,678,439 A * 7/1987 Schlichthorst ..... 440/11
5,111,763 A 5/1992 Moerbe
5,417,597 A * 5/1995 Levedahl ..... 440/6
5,558,036 A * 9/1996 Hara ..... 114/249
6,182,593 B1 2/2001 Wierick
7,341,422 B1 3/2008 McCown et al.

* cited by examiner

*Primary Examiner*—Stephen Avila
(74) *Attorney, Agent, or Firm*—Thompson Hine LLP

(57) ABSTRACT

A modified marine vessel system including a marine vessel configured to carry and transport marine freight in an ocean environment, and at least one engine module carried on the marine vessel. The engine module includes an engine housed inside a marine freight container. The system further includes a propeller and a power coupling operably connecting the engine and the propeller such that the propeller is rotatably drivable by the engine, wherein the power coupling does not extend through a hull of the marine vessel.

26 Claims, 7 Drawing Sheets

MARINE VESSEL AND SYSTEM FOR OPERATING A MARINE VESSEL

The present invention is directed to a marine vessel, such as a barge, and more particularly, to a marine vessel which carries a propulsion unit thereon.

BACKGROUND

Marine vessels provide an efficient and cost-effective mode for transporting containerized freight. The use of containers in marine shipping provides the benefits associated with containerization, for example, ease of handling, ease of loading and unloading the containers, protection of freight, etc. Marine vessels are often used to transport containers across relatively long distances. Accordingly, any increase in shipping efficiency can provide significant benefits to the shipping company, as well as its customers.

SUMMARY

In one embodiment, the present invention is a marine vessel, such as a modified barge, which provides increased efficiencies. In particular, in one embodiment the invention is a modified marine vessel system including a marine vessel configured to carry and transport marine freight in an ocean environment, and at least one engine module carried on the marine vessel. The engine module includes an engine housed inside a marine freight container. The system further includes a propeller and a power coupling operably connecting the engine and the propeller such that the propeller is rotatably drivable by the engine, wherein the power coupling does not extend through a hull of the marine vessel.

DETAILED DESCRIPTION

Figure 1:
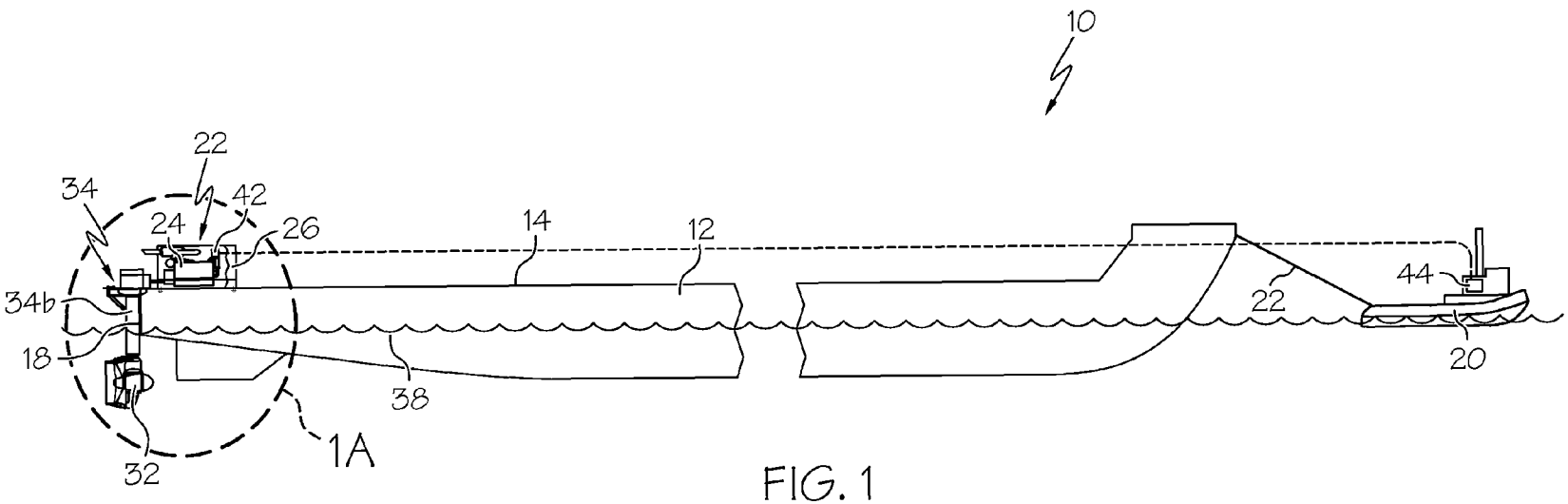
FIG. 1 is a side view of one embodiment of the system of the present invention, with part of the engine module cut away to reveal an engine therein.
Figure 4:
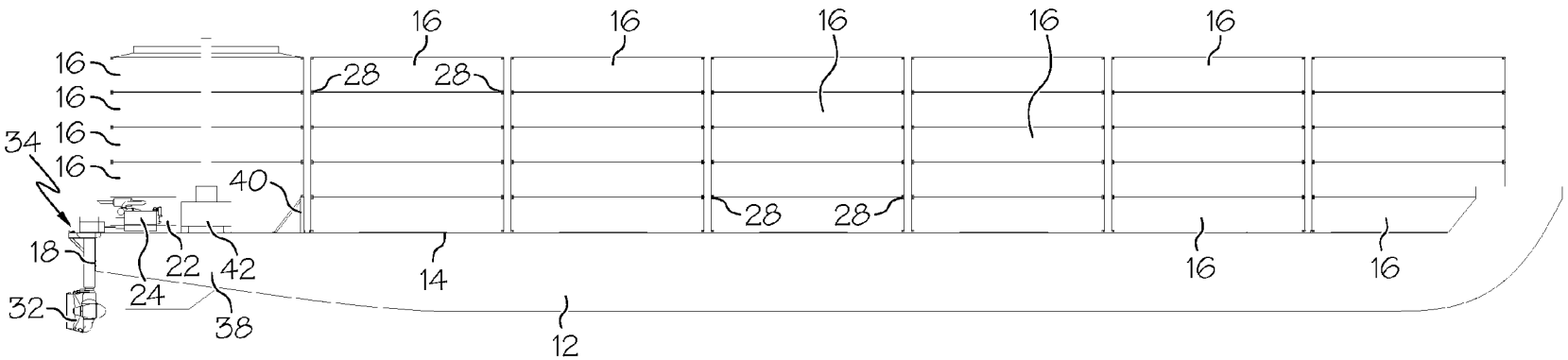
FIG. 4 is a side view of the entire marine vessel of FIG. 3.
Figure 5:
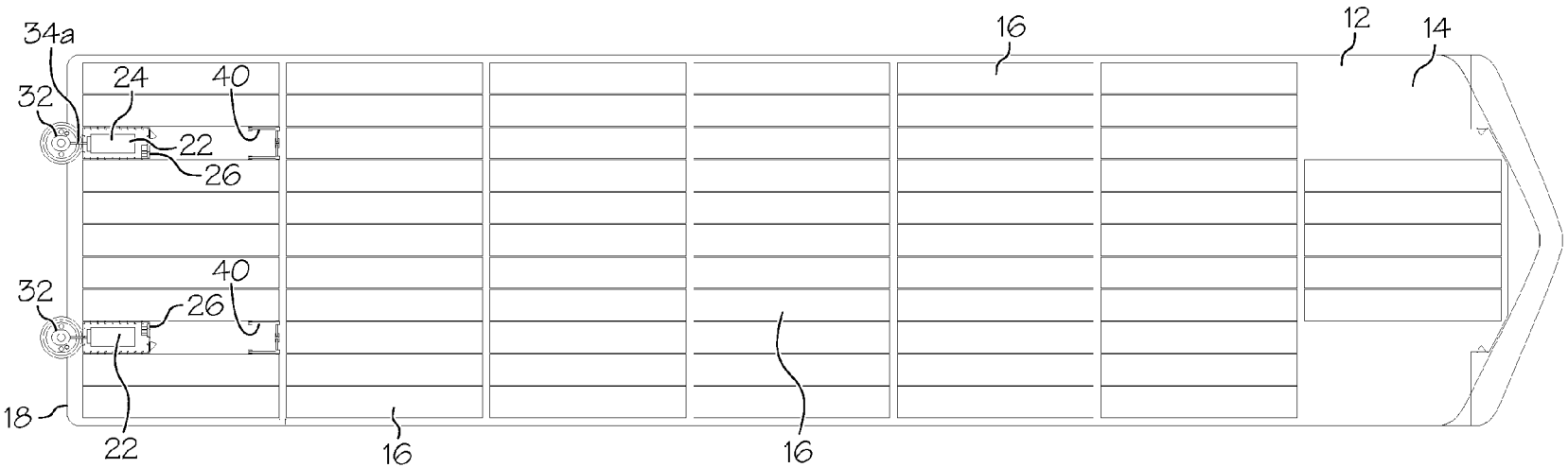
FIG. 5 is a top view of the marine vessel of FIG. 4.
Figure 6:
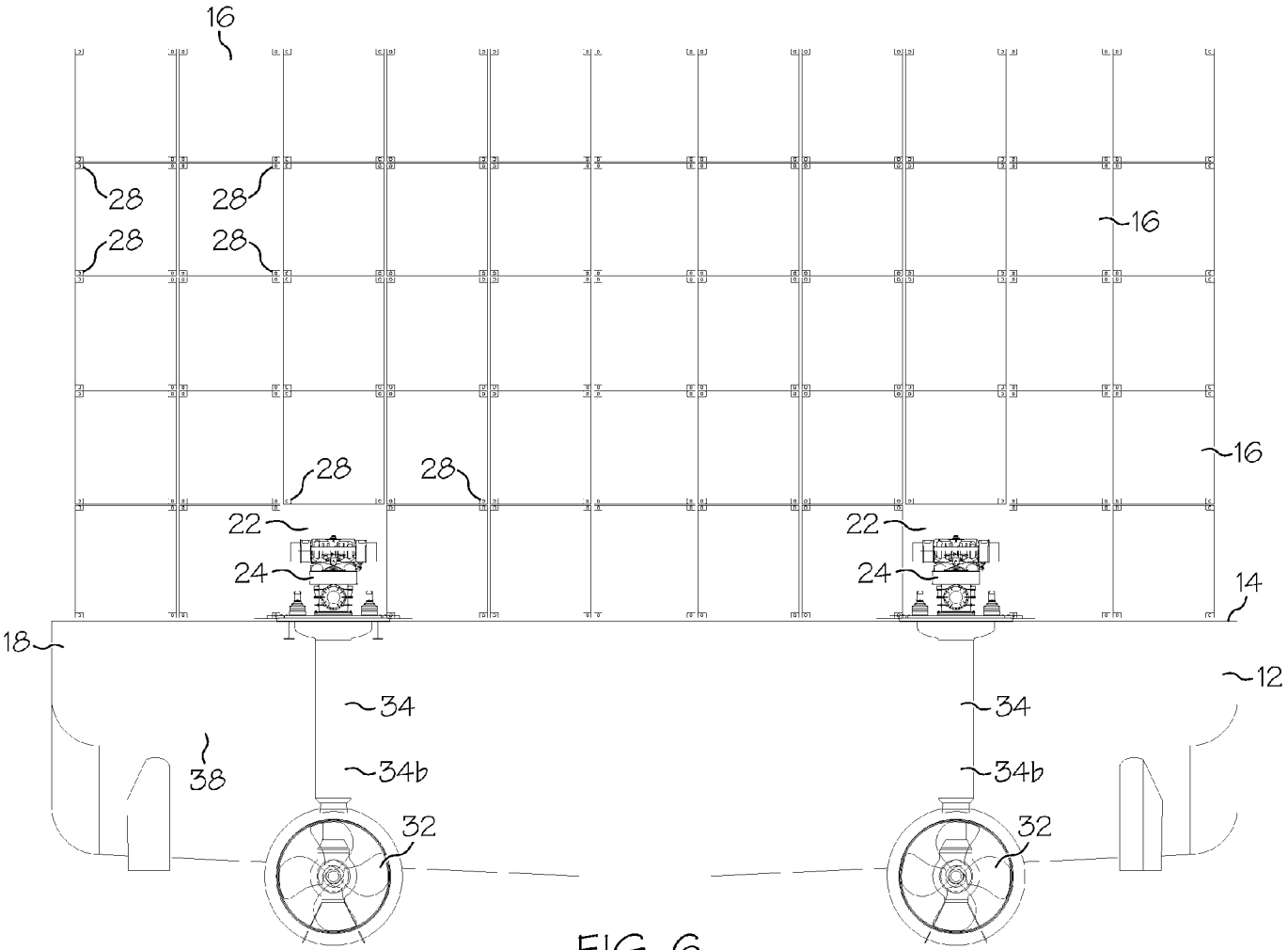
FIG. 6 is an end view of the marine vessel of FIG. 4.

As shown in FIG. 1, the system 10 of the present invention may include a marine vessel, such as a barge 12 or the like. The barge 12 may be an ocean-going vessel that is sufficiently large, stable and rugged to operate at open sea. The barge 12 may include a deck that is sufficiently strong to support multiple shipping containers 16 (i.e. stacked up to five containers high, or even higher) and support a large number of containers 16 (as shown in FIGS. 4-6). For example, the barge 12 may have a length of at least about 200 feet, or in another embodiment, at least about 400 feet, and in yet another embodiment, at least about 600 feet. The barge 12 may be capable of carrying a relatively large number of loaded containers 16, such as, in one embodiment, at least about 200 containers and in another embodiment, at least about 300 containers. The barge 12 may have a breadth of at least about 50 feet, or in another embodiment, at least about 75 feet. The barge 12 may be a generally flat-bottomed vessel with a generally straight (i.e. vertical) stern 18, and with a pointed bow to increase towing efficiency. As shown in FIG. 1, a tug or other vessel (i.e. termed a "lead vessel" 20 herein) may be secured to the marine vessel by cable or the like 22 such as the lead vessel 20 can pull the barge 12 as desired.

The system 10 may include an engine module 22 carried on the barge 12, wherein the engine module includes an engine 24 housed inside a marine freight container 26. The marine freight container 26 can be a shipping container of generally conventional design, but for use in a marine environment. For example, the container 26 may be a generally rectangular prism having walls, floor and roof made of aluminum, or other suitable materials, with large, integrated doors at least one end thereof.

Figure 1A:
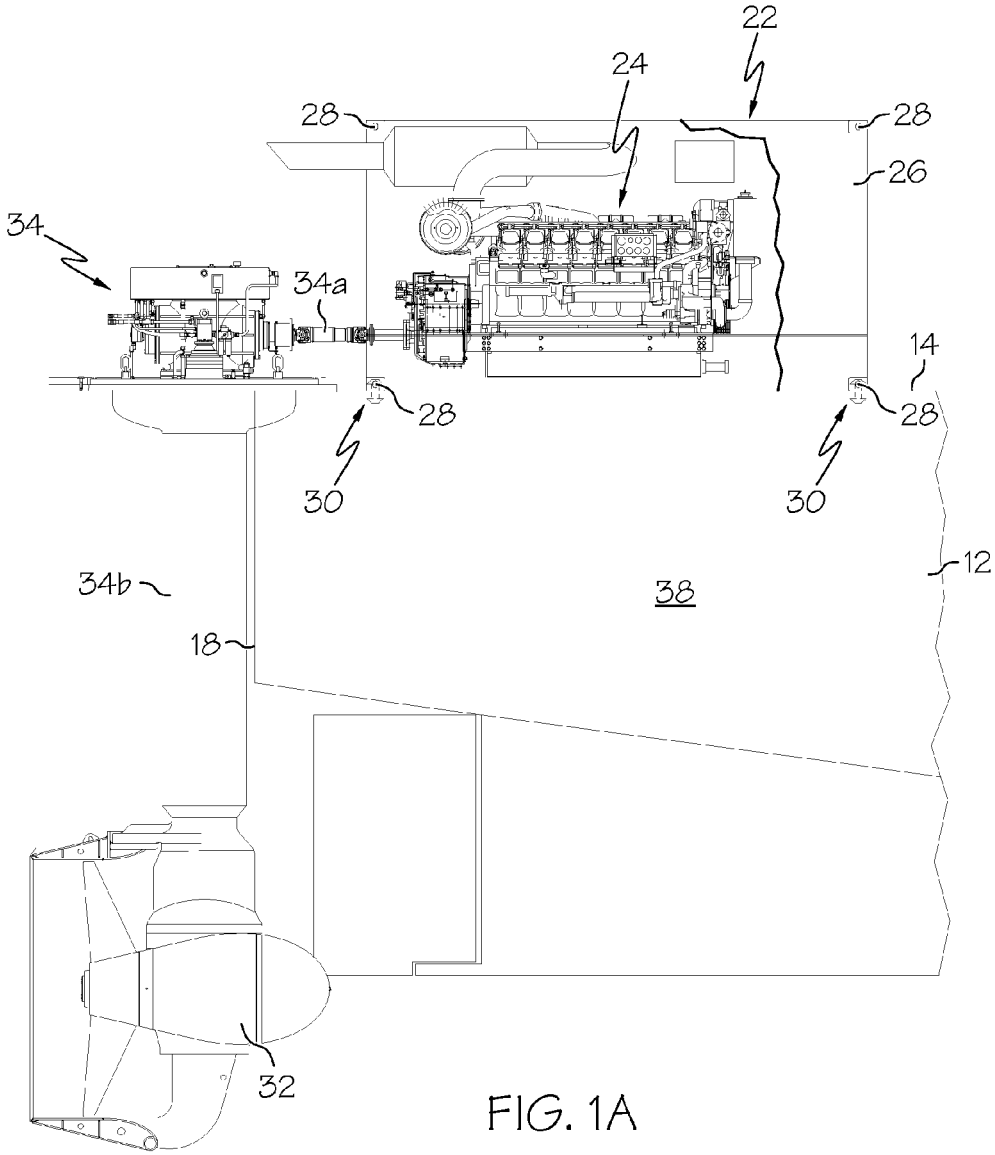
FIG. 1A is a detail view of the area designated in FIG. 1.

The container 26 may include corner casting 28 at each corner (and, if desired, at other intermediate locations) to allow the container 28 to be coupled to the deck 14 and/or other containers 16. For example, FIG. 1A schematically illustrates twist locks 30 received in the corner castings 28 of the container 26, and in the deck 14 of the barge 12, to secure the engine module 22 to the deck 14. In one embodiment, the twistlocks 30 are model C5AM-DF double cone semi-automatic twistlocks, manufactured by Buffers USA of Jacksonville, Fla. The corner castings 28 may also be manufactured by Buffers and may be of the standard ISO type. Further information regarding the barge 12, containers 16/26, and other components can be found in U.S. patent application Ser. No. 09/057,313 entitled CONTAINER TRANSPORTATION SYSTEM AND METHOD, filed on Apr. 8, 1998, the entire contents of which are hereby incorporated by reference.

The container 26 may be sized to generally correspond to the size of the engine 24 housed therein such that the engine 24 is relatively closely received in the container 26, but allows sufficient space around the engine 24 for air circulation, access, maintenance etc. In one embodiment, the container 26 has a length of at least about ten feet, and more particularly at least about twenty feet in another embodiment, although containers of various different sizes can be used as desired.

The engine 24 may be operably connected to a propeller or other thrust device 32 (collectively termed a propeller herein) by a power coupling/power transmission/gearing 34 such that the propeller 32 is rotatably driven by the engine 24. The engine 24 can be of various shapes, sizes, makes and models, but in one embodiment, the engine 24 is a Caterpillar® 3516B engine that can provide 2,500 hp at 1,600 rpm, and the propeller 32 is a Schottel® SRP 2020 azimuth thruster. Fuel for the engine 24 may be stored in a compartment of the hull (not shown) which is sufficiently segregated from the remainder of the hull to safely store fuel therein. Alternately, portable fuel tanks may be utilized.

The propeller 32/power coupling 34 may be a z-drive type of azimuth thruster. In the illustrated embodiment, the power coupling 34 includes a generally horizontal portion 34*a* which is coupled to the power take-off shaft of the engine 24, and a generally vertical component 34*b* to transmit the rotational power down to the propeller 32. Thus, the power coupling 34 extends at two right angles and does not extend through, pierce, or otherwise compromise the hull 38 of the vessel 12. Thus, all or substantially all of the power coupling 34 is positioned externally of the hull 38 such that no penetration of the hull 38 is required. The generally flat or vertical stern 18 allows the vessel 12 to easily accommodate the z-drive. If desired, the propeller 32 may be rotatable (i.e. about a vertical axis) or otherwise be steerable or controllable to control the direction of thrust. Alternately, the propeller 32 provides only straight-forward thrust in a single direction.

Figure 2:
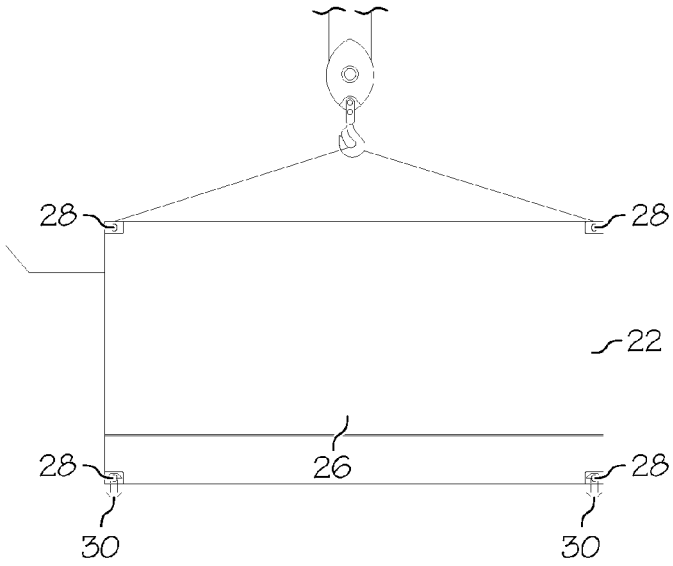
FIG. 2 is a side view of the system of FIG. 1A, with the engine module being lifted away from the deck of the vessel.
Figure 2:
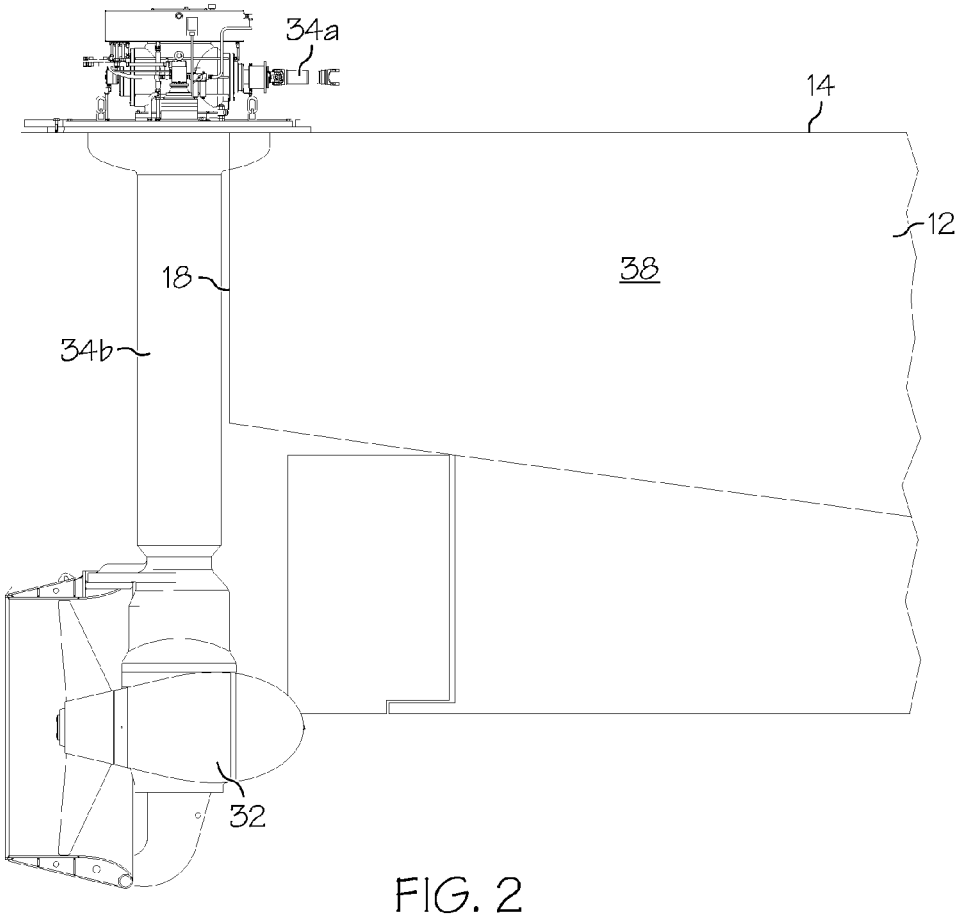

The engine module 22 can be releasably coupled to the deck 14 of the vessel 12 by twist locks 30 or the like. In this manner, when the engine 24 malfunctions, or needs to be serviced or replaced, the power coupling 34 can be decoupled from the engine 24, and the engine module 22 can be decoupled from the deck (i.e. by releasing the associated twist locks 30). Next, the engine module 22 can be lifted up by a crane or the like (FIG. 2), and replaced with another engine module 22. Accordingly, the modular nature of the engine module 22 allows the engine module 22 to be easily switched out, as necessary.

Figure 3:
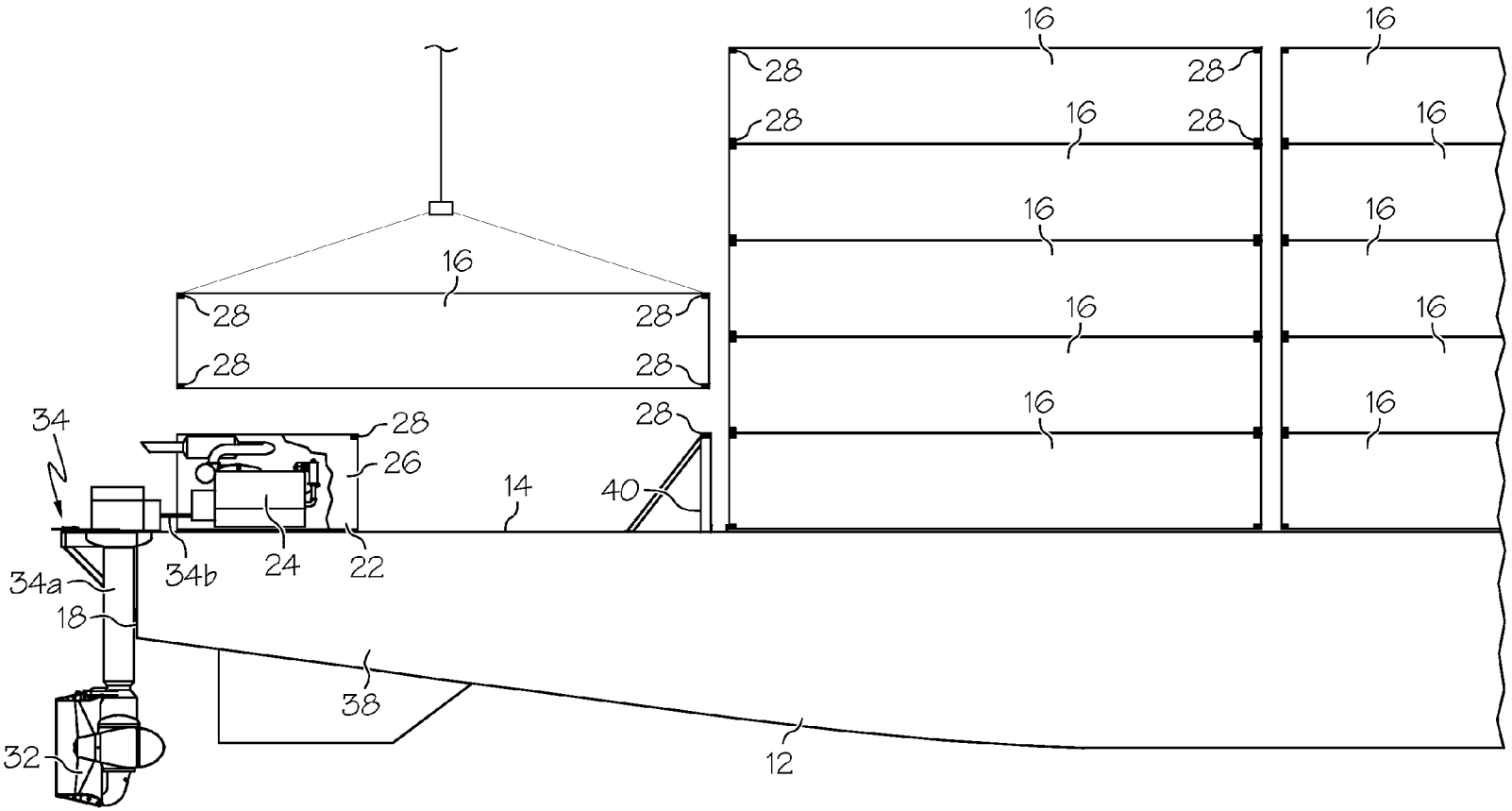
FIG. 3 is a detail side view of the marine vessel of FIG. 1, carrying multiple containers thereon and with a container being paced on the engine module.

As shown in FIG. 3, other marine containers 16, such as 40 foot long, 53 foot long, or other lengths of containers 16 can be stacked on top of the engine module 22. In the embodiment shown in FIG. 3, the engine module container 26 includes corner casting 28 on its roof (see also FIGS. 1A and 2) which are configured to receive a twist lock 30 therein to couple the containers 16 and 26. Moreover, a support structure 40 (such as a post, wall or the like) may be located on the deck 14 and positioned to support the opposite end of an upper container 16. The support structure 40 can have corner casting 28 thereon. In this manner, a container 16 can be positioned on top of the engine module 22 and the support structure 40 such that the corner casting 28 of the container 16 are secured to the engine module 22/support structure 40 by twistlocks.

Thus, a container 16 can be stacked directly on top of the engine module 22, and further containers 16 can be stacked on top of that container 16 (as shown in FIG. 4). As shown in FIGS. 4 and 5, multiple containers 16 can be stacked on the deck 14 of the barge 12 to provide a fully loaded barge 12. Thus, it can be seen that the engine module 22 takes up very little space; i.e. the space of only one container 16 or equivalent unit. If desired, as shown in FIG. 4, rather than using a crane, the containers 16 can be stacked and moved using a reach stacker 42.

More than one engine module 22 may be utilized. For example, as shown in FIG. 5, two engine modules 22, located on opposed sides of the center line of the vessel 12, may be provided at or adjacent to the stern 18 of the vessel 12. Each engine module 22 can have the characteristics described above. For example, when each engine 24 has an output of 2,500 hp, a total output of 5,000 hp may be provided. The use of two (or more) engine modules 22 provides greater stability, and also provides for a level of redundancy should one of the engines 24 malfunction. Each engine module 22 can have its own associated power coupling 34 and propeller 32.

As shown in FIG. 1, each engine module 22 may include a controller 42 which can control operations of the associated engine 24. Each controller 42 may be wirelessly connected to a supervisory controller 44 such that the supervisory controller 44 can send signals to the controller 42 to thereby independently control operations of each engine 24. In the illustrated embodiment, the supervisory controller 44 is carried on the lead ship 20. In this manner, the operator of the lead ship 20 can control operations of the engines 24 to control, for example, the on/off status of the engines 24, the thrust and/or direction of each engine 24, propeller 32, etc. The wireless connection between controllers 42, 44 can be provided by various means, such as, for example radio frequency, satellite signals or the like. Although a separate controller 42 for each engine 24 may be utilized, if desired, only a single controller 42 may be utilized to control both engines 24.

Each controller 42 and/or the supervisory controller 44 may be configured to provide automatic shut-down of the associated engine 24 (or engines) upon the occurrence of a predetermined event or events. For example, overheating of the engine 24, sufficient rise in temperature, sufficiently lowered visibility conditions, detection of smoke, detection of various other engine abnormalities, or persistent loss of signal from the supervisory controller 44 may cause the controller 42 to automatically shut down the associated engine 24 or engines 24. The controllers 42/44 may also be configured to cause automatic shutdown of the engine(s) 24 when the barge 12 enters a port (as detected by a GPS system or other signals).

In operation, each container 16 may be loaded on the vessel 12 with a crane, reach stacker, or otherwise, but not in a roll-on/roll-off manner, as the engine modules 22 may prevent roll-on-roll-off loading and unloading. The vessel 12 is coupled to the lead vessel 20 by the cable 22 or other towing arrangement to provide a pulling force to the barge 12. The supervisory controller 44 on the lead vessel 20 is operatively connected to the controllers 42 to control operations of the engines 24 and propellers 32. In this manner, the engine modules 22 can be remotely operated to provide a "power assist" to the lead vessel 20. This towing arrangement provides a number of advantages. For example, most barges 12 require skegs in the form of angled/camfered sternward extensions of the keel to improve the directional stability of the vessel via the drag forces added by the skegs. However, the additional drag added by the skegs lowers efficiency and speed. In contrast, when the engine modules 22 of the present invention are utilized, the forward thrust of the propellers 32 provides stability to the towing system, thereby eliminating the need for the skegs. It has been found that skegs can consume up to 10% of power when towing a barge. Accordingly, elimination of the skegs can significantly increase towing efficiency and speed. Alternately, rather than eliminating the skegs entirely, the skegs can be reduced in size, or "straightened" such that they are generally aligned with the longitudinal axis of the vessel 12, which provides stability and significantly reduced drag.

Moreover, the use of the engine assist (i.e. operation of the engines 24) can reduce unit costs per mile. In particular, although each engine 24 consumes fuel, the increased efficiency due to the elimination of skegs results in a significant net gain of fuel efficiency of the system, as compared to a standard tug/barge towing arrangement. In addition, the engine assist of the present invention increases towing speed.

The thrust provided by the engine modules 22 may also allow the size/power of the lead vessel 20 to be reduced, thereby decreasing fuel costs, maintenance costs, and initial up-front investment required to operate the lead vessel 20. Moreover, the engine modules 22 may have automatic gyroscopic control or the like to ensure that the barge 12 is always aligned in the desired manner to make most efficient use of the power assists provided by the engines 24 and to improve navigational control. If desired, multiple barges 12 can be connected together in a stern-to-bow arrangement, with each barge having engine modules 22 thereon to provide the engine assist benefits described above. In this case a plurality of barges 12 are coupled to, and trail behind, other barges to create a chain of barges.

Due to the remote control of the engines 24, as well as automatic shutdown of the engines 24 in predetermined circumstances, the barge 12 will be capable of being unmanned. More particularly, United States Coast Guard regulations may recognize/classify the vessel 12 of FIG. 1 as a barge (i.e. an unmanned vessel), thereby eliminating any requirement to place workers on the vessel 12, which would significantly increase operating costs. In this manner, the vessel 12 can be considered a fully automated, unmanned barge which nevertheless provides thrust assistance.

In addition, as noted above, each engine module 22 is modular in manner, thereby allowing easy repair and replacement. Moreover, each engine module 22 requires minimal space, taking only one equivalent unit, and allows containers 26 to be stacked directly on top of the engine module 22.

In addition, existing unmanned barges can be easily modified to provide the system shown herein. In particular, a standard barge with a straight stern configured to transport marine freight in an ocean environment can first be provided. The desired number of engine modules 22 are then mounted on the barge 12, along with the propellers 32 and the power couplings 34 in the manner shown and described above. Containers 16 are then loaded on the barge 12, and a lead vessel 20 coupled to the barge with power assist provided by the engine module 22/propeller 32. In this manner, the existing barges can be modified to provide/operate the system shown and described herein. If desired, the engine module 22, propellers 32, and power couplings 34 can be removed from the barge to return the barge to its original condition.

Having described the invention in detail and by reference to the preferred embodiments, it will be apparent that modifications and variations thereof are possible without departing from the scope of the invention.

What is claimed is:

1. A modified marine vessel system comprising:

a marine vessel configured to carry and transport marine freight in an ocean environment;

at least one engine module carried on said marine vessel, said engine module including an engine housed inside a container;

a propeller; and a power coupling operably connecting said engine and said propeller such that said propeller is rotatably drivable by said engine, wherein said power coupling does not extend through a hull of said marine vessel, wherein said engine module is releasably connected to said marine vessel and releasably operably connected to said power coupling such that said engine module is removable from said marine vessel and from said power coupling and is replaceable with another engine module in a modular manner.

2. The marine vessel system of claim 1 wherein at least two engine modules are carried on said marine vessel, wherein each engine module is operably connected to its own propeller by its own power coupling, and wherein each power coupling does not extend through said hull of said marine vessel, and wherein each engine module is releasably connected to said marine vessel and releasably operably connected to said power coupling such that each engine module is removable from said marine vessel and said power coupling replaceable with another engine module in a modular manner.

3. The marine vessel system of claim 1 wherein said container includes a plurality of corner castings to allow said container to be releasably connected to said marine vessel by the use of twistlocks.

4. The marine vessel system of claim 1 wherein said container is releasably connectable to said marine vessel and to other freight containers by the use of twistlocks.

5. The marine vessel system of claim 1 wherein said engine module is positioned on a top deck of said marine vessel.

6. The marine vessel system of claim 1 further comprising a lead ship coupled to said marine vessel to pull and guide said marine vessel, and wherein said marine vessel includes a plurality of cargo containers stacked thereon, and wherein at least one cargo container is directly stacked on top of said engine module.

7. The marine vessel system of claim 1 further comprising a lead ship coupled to said marine vessel to pull and guide said marine vessel, and wherein said marine vessel includes a plurality of cargo containers stacked thereon, and wherein said marine vessel is unmanned.

8. The marine vessel system of claim 1 wherein said engine module includes a controller that is wirelessly connected to a supervisory controller such that said supervisory controller can send signals to said controller to thereby control operations of said engine.

9. The marine vessel system of claim 8 further comprising a lead ship coupled to said marine vessel to pull and guide said marine vessel, and wherein said supervisory controller is carried on said lead ship.

10. The marine vessel system of claim 1 wherein said marine vessel lacks any angled skegs.

11. The marine vessel system of claim 1 further comprising a supplemental modified marine vessel having the same characteristics as said marine vessel of claim 1, wherein said supplemental modified marine vessel is coupled to, and trails behind, said marine vessel to create a chain of marine vessels.

12. The marine vessel system of claim 1 wherein said container housing said engine therein is a generally rectangular prism having a length of at least about 10 feet and is configured to contain and protect freight in a marine environment.

13. The marine vessel system of claim 1 wherein substantially all of said power coupling is positioned externally of said hull such that no penetration of said hull is required.

14. The marine vessel system of claim 1 wherein said marine vessel is carrying at least about 200 marine containers on its deck.

15. The marine vessel system of claim 1 wherein said marine vessel is a barge.

16. A marine vessel system comprising:

a marine vessel configured to carry and transport marine freight in an ocean environment;

at least one engine carried on said marine vessel;

a propeller; and a power coupling releasably operably connecting said engine and said propeller such that said propeller is rotatably drivable by said engine to thereby propel or aid in propelling said marine vessel, wherein said power coupling does not extend through a hull of said marine vessel, wherein said engine is releasably connected to said marine vessel and releasably operably connected to said power coupling such that said engine is removable from said marine vessel and from said power coupling and is replaceable with another engine in a modular manner.

17. A method for shipping freight system comprising:

accessing a marine vessel configured to carry and transport marine freight in an ocean environment, said marine vessel having at least one engine module carried thereon, said engine module including an engine housed inside a container, said marine vessel further including a propeller and a power coupling operably connecting said engine and said propeller such that said propeller is rotatably drivable by said engine to thereby propel or aid in propelling said marine vessel, wherein said power coupling does not extend through a hull of said marine vessel, wherein said engine module is releasably connected to said marine vessel and releasably operably connected to said power coupling such that said engine module is replaceable with another engine module in a modular manner;

loading freight on said marine vessel; and towing said marine vessel with a lead ship while said engine rotatably drives said propeller.

18. The method of claim 17 wherein said marine vessel is unmanned during said towing step.

19. A method for modifying a marine vessel comprising:

accessing a marine vessel configured to carry and transport marine freight in an ocean environment;

releasably mounting at least one engine module on said marine vessel, said engine module including an engine housed inside a container;

providing a propeller; and releasably operably connecting said propeller and said engine with a power coupling such that said propeller is rotatably drivable by said engine, wherein said power coupling does not extend through a hull of said marine vessel, wherein said engine module is releasably connected to said marine vessel and releasably operably connected to said power coupling such that said engine module is removable from said marine vessel and from said power coupling and is replaceable with another engine module in a modular manner.

20. The method of claim 19 wherein said marine vessel is a barge.

21. The system of claim 1 wherein said engine module is disconnectable from said power coupling by lifting said engine module away from said marine vessel and said engine module is replaceable with another engine module which is connectable to said power coupling in a modular manner.

22. The system of claim 1 wherein said engine module is operably disconnectable from said propeller by lifting said engine module away from said marine vessel and said engine module is replaceable with another engine module which is operably connectable to said propeller in a modular manner.

23. The system of claim 1 wherein said container generally corresponds to the size of said engine such that said engine is closely received therein.

24. The system of claim 1 wherein said marine vessel is unmanned and is carrying and transporting freight in an ocean environment.

25. The system of claim 1 wherein said container is a marine freight container.

26. The system of claim 1 wherein said propeller is directly coupled to said marine vessel.

* * * * *